US007128828B1

(12) United States Patent
Kalnes

(10) Patent No.: US 7,128,828 B1
(45) Date of Patent: Oct. 31, 2006

(54) PROCESS FOR PRODUCING FOOD GRADE WAX

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 400 days.

(21) Appl. No.: 10/378,017

(22) Filed: Feb. 28, 2003

Related U.S. Application Data

(63) Continuation-in-part of application No. 09/759,538, filed on Jan. 12, 2001, now abandoned.

(51) Int. Cl.
*C10G 45/04* (2006.01)
*C10G 45/02* (2006.01)

(52) U.S. Cl. ..... 208/89; 208/88; 208/143; 208/229; 208/209; 208/228; 208/213

(58) Field of Classification Search ..... 208/89, 208/88, 143, 229, 209, 228, 213
See application file for complete search history.

(56) References Cited

U.S. PATENT DOCUMENTS

| | | | | |
|---|---|---|---|---|
| 5,068,484 | A | 11/1991 | James, Jr. et al. | 585/469 |
| 5,082,551 | A | 1/1992 | Reynolds et al. | 208/100 |
| 5,114,562 | A | 5/1992 | Haun et al. | 208/89 |
| 5,980,729 | A | 11/1999 | Kalnes et al. | 208/89 |

*Primary Examiner*—Tam M. Nguyen
(74) *Attorney, Agent, or Firm*—John G. Tolomei; James C. Paschall; John C. Cutts, Jr.

(57) ABSTRACT

A process for producing food grade wax which contains exceedingly low levels of nitrogen, sulfur and aromatic compounds. A waxy feedstock is firstly hydrotreated in a first hydrogenation zone to reduce the level of contaminants such as sulfur, nitrogen and aromatic compounds, and the resulting effluent from the first hydrogenation zone is introduced into a hot, high pressure stripper and contacted with a hot, hydrogen-rich stripping gas to remove ammonia and hydrogen sulfide. The stripped, hot liquid hydrocarbons are removed from the bottom of the hot, high-pressure stripper to further reduce the concentration of aromatic compounds by being hydrogenated in a second hydrogenation zone containing a platinum or palladium catalyst.

8 Claims, 1 Drawing Sheet

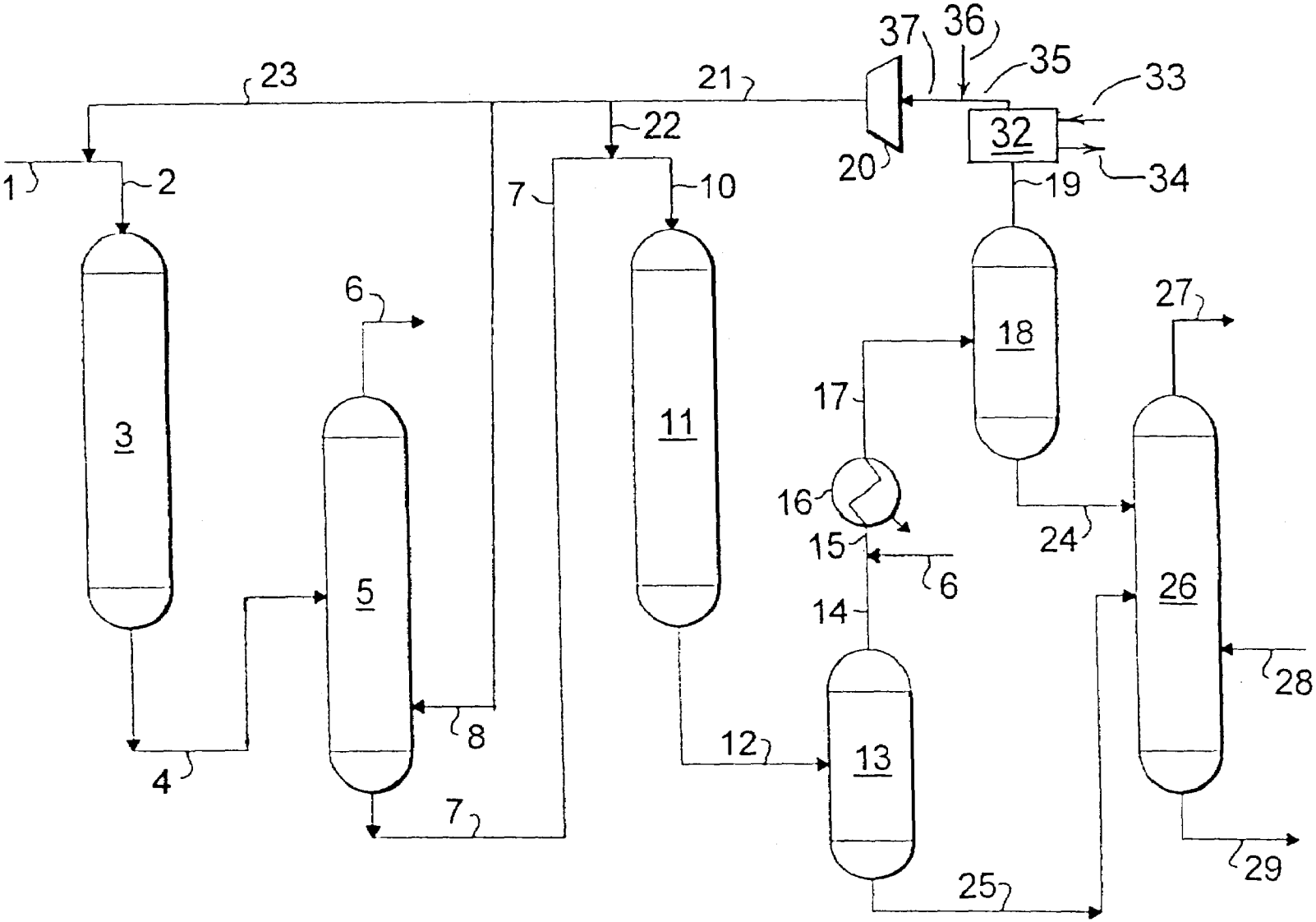
1
2
3
4
5
6
7
8
10
11
12
13
14
15
16
17
18
19
20
21
22
23
24
25
26
27
28
29
32
33
34
35
36
37

PROCESS FOR PRODUCING FOOD GRADE WAX

CROSS REFERENCE TO RELATED APPLICATION

This application is a continuation-in-part of prior copending U.S. application Ser. No. 09/759,538, filed Jan. 12, 2001, now abandoned which is incorporated herein by reference in its entirety.

BACKGROUND OF THE INVENTION

The field of the art to which this invention pertains is the production of food grade wax from a feedstock containing wax. Hydrocarbon feedstocks containing wax is used to produce wax and particularly food grade wax which is in commercial demand. These feedstocks contain sulfur, nitrogen and aromatic compounds and must be refined and separated to produce food grade wax which meets stringent purity specifications. Hydrotreating is utilized to react a hydrocarbonaceous feedstock and a hydrogen-rich gaseous stream with a hydrotreating catalyst to remove sulfur and nitrogen, and to saturate aromatic compounds. This is accomplished by contacting the particulate catalyst with a hydrocarbonaceous feedstock under conditions of elevated temperature and pressure and in the presence of hydrogen so that the sulfur components are converted to hydrogen sulfide, and nitrogen components to ammonia. Hydrotreating is typically employed to reduce the concentration of nitrogen and sulfur in feedstocks: A typical hydrotreating catalyst contains hydrotreating metals and/or other promoters on a porous refractory oxide support. Hydrotreating metals usually include Group VIB and/or Group VIII active metal components supported on a porous refractory oxide support such as alumina.

Although a wide variety of process flow schemes, operating conditions and catalysts have been used in commercial activities to produce purified wax, there is always a demand for new and more advantageous methods. The present invention is able to produce food grade wax from petroleum-derived feedstocks.

INFORMATION DISCLOSURE

U.S. Pat. No. 5,068,484 (James, Jr. et al) discloses a process for the production of a hydrogenated hydrocarbonaceous product from a feedstock comprising organic compounds having a tendency to readily form polymer compounds by means of contacting the feed with a hydrogenated recycle liquid containing dissolved hydrogen in a first hydrotreating reaction zone operated at hydrotreating conditions selected to minimize a hydrogen-rich gaseous phase and to selectively hydrogenate organic compounds having a tendency to readily form polymer compounds and to produce a first hydrogenated stream comprising hydrocarbonaceous compounds and having a reduced concentration of polymer precursors. The resulting first hydrogenated stream is then contacted in a second hydrotreating zone with added hydrogen to produce a hydrogenated stream comprising hydrogenated hydrocarbonaceous compounds.

U.S. Pat. No. 5,980,729 (Kalnes et al) discloses a hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream.

U.S. Pat. No. 5,114,562 (Haun et al.) discloses a multi-reaction zone process for the production of low aromatics, low sulfur jet fuel or diesel fuel. The process employs two reaction zones, one for desulfurization and one for hydrotreating in a series flow arrangement and is characterized by a unique hydrogen flow combined with the hydrogen stripping of the effluent from the first reaction zone to remove hydrogen sulfide. The '562 patent teaches that the effluent from the first reaction zone (desulfurization) is cooled by heat-exchange before hydrogen stripping. The '562 patent also teaches the use of noble metal hydrogenation catalysts.

U.S. Pat. No. 5,082,551 (Reynolds et al.) discloses a hydroconversion effluent separation process wherein the effluent from the hydroconversion zone is passed to a hot high pressure separation zone. The gas phase from that zone is then passed to a cold high pressure separation zone while the liquid hydrocarbon bottoms is passed to a hot low pressure vapor-liquid separation zone. The gas phase is partially condensed in the cold high pressure separation zone to produce a hydrogen-rich gas and a liquid hydrocarbon bottom stream. The overhead from the hot low pressure vapor-liquid separation zone is fed to a cold low pressure vapor-liquid separation zone. The gas phase from the cold low pressure vapor-liquid separation zone is recycled to the hydroconversion zone. The liquid hydrocarbon bottom stream from the cold high pressure separation zone is fed to a cold low pressure vapor-liquid separation zone or a fractionation zone. The bottoms stream from the hot low pressure vapor-liquid separation zone is fed to a distillation section.

BRIEF SUMMARY OF THE INVENTION

The present invention is an integrated two-stage hydrogenation process which is economically capable of producing food grade waxes which contain low levels of nitrogen, sulfur and aromatic compounds. A hydrocarbon feedstock containing high concentrations of wax is firstly hydrotreated in a first hydrogenation zone to reduce the level of contaminants such as sulfur, nitrogen and aromatic compounds and the resulting effluent from the first hydrogenation zone is introduced without cooling into a hot, high-pressure stripper and contacted with a hydrogen-rich stripping gas to remove ammonia, hydrogen sulfide and non-waxy hydrocarbons. The stripped, hot liquid waxy hydrocarbons are removed from the bottom of the hot, high-pressure stripper and introduced along with hydrogen into a second hydrogenation zone to further reduce the concentration of aromatic compounds. The process further provides the ability to utilize sulfur-sensitive and highly active catalysts in the second hydrogenation zone.

In one embodiment, the present invention is a process for producing food grade wax from a feedstock selected from the group consisting essentially of de-oiled paraffin waxes, de-oiled microcrystalline waxes, deasphalted residual oils and slack wax which process comprises: (a) contacting the feedstock and hydrogen with a hydrotreating catalyst in a first hydrogenation zone; (b) passing the resulting effluent without cooling from the first hydrogenation zone to an interstage separator operated at the hydrogenation zone outlet pressure to strip hydrogen sulfide, ammonia and non-waxy hydrocarbons by countercurrent contact with a first hydrogen-rich gaseous stream; (c) passing a liquid waxy hydrocarbonaceous stream from the interstage separator and a second hydrogen-rich gaseous stream and contacting the resulting stream with a hydrogenation catalyst comprising platinum or palladium in a second hydrogenation zone to saturate aromatic compounds; (d) passing the resulting effluent from the second hydrogenation zone to a first vapor-liquid separator operated at a temperature from about 149° C. (300° F.) to about 260° C. (500° F.) to maintain the waxy hydrocarbonaceous stream as a liquid; (e) passing the liquid waxy hydrocarbonaceous stream from the first vapor-liquid separator to a fractionation zone; (f) passing a vapor stream comprising hydrogen and non-waxy hydrocarbons from the first vapor-liquid separator to a second vapor-liquid separator operated at a temperature from about 10° C. (50° F.) to about 65° C. (150° F.); (g) passing at least a portion of a third hydrogen-rich gaseous stream recovered from the second vapor-liquid separator to provide at least a portion of the first hydrogen-rich gaseous stream in step (b) and at least a portion of the second hydrogen-rich gaseous stream in step (c); (h) passing a stream comprising non-waxy hydrocarbons from the second vapor-liquid separator to a fractionation zone; and (i) recovering a food grade wax.

In another embodiment, the present invention is a process for producing food grade wax from a feedstock selected from the group consisting essentially of de-oiled paraffin waxes, de-oiled microcrystalline waxes, deasphalted residual oil and slack wax which process comprises: (a) contacting the feedstock and hydrogen with a hydrotreating catalyst comprising nickel, molybdenum and phosphorus in a first hydrogenation zone; (b) passing the resulting effluent without cooling from the first hydrogenation zone to an interstage separator operated at the hydrogenation zone outlet pressure to strip hydrogen sulfide, ammonia and non-waxy hydrocarbons by countercurrent contact with a first hydrogen-rich gaseous stream; (c) passing a liquid waxy hydrocarbonaceous stream from the interstage separator and a second hydrogen-rich gaseous stream and contacting the resulting stream with a hydrogenation catalyst comprising platinum or palladium in a second hydrogenation zone to saturate aromatic compounds; (d) passing the resulting effluent from the second hydrogenation zone to a first vapor-liquid separator operated at a temperature from about 149° C. (300° F.) to about 260° C. (500° F.) to maintain the waxy hydrocarbonaceous stream as a liquid; (e) passing the liquid waxy hydrocarbonaceous stream from the first vapor-liquid separator to a fractionation zone; (f) passing a vapor stream comprising hydrogen and non-waxy hydrocarbons from the first vapor-liquid separator to a second vapor-liquid separator operated at a temperature from about 10° C. (50° F.) to about 65° C. (150° F.); (g) passing at least a portion of a third hydrogen-rich gaseous stream recovered from the second vapor-liquid separator to provide at least a portion of the first hydrogen-rich gaseous stream in step (b) and at least a portion of the second hydrogen-rich gaseous stream in step (c); (h) passing a stream comprising non-waxy hydrocarbons from the second vapor-liquid separator to a fractionation zone; and (i) recovering a food grade wax.

In yet another embodiment, the present invention is a process for producing food grade wax from a feedstock selected from the group consisting essentially of de-oiled paraffin waxes, de-oiled microcrystalline waxes, deasphalted residual oil and slack wax which process comprises: (a) contacting the feedstock and hydrogen with a hydrotreating-catalyst comprising nickel, molybdenum and phosphorus in a first hydrogenation zone operated at conditions including a temperature from about 260° C. (500° F.) to about 482° C. (900° F.) and a pressure from about 3.5 MPa (500 psig) to about 17.3 MPa (2500 psig); (b) passing the resulting effluent without cooling from the first hydrogenation zone to an interstage separator at the hydrogenation zone outlet pressure to strip hydrogen sulfide, ammonia and non-waxy hydrocarbons by counter current contact with a first hydrogen-rich gaseous stream; (c) passing a liquid waxy hydrocarbonaceous stream from the interstage separator and a second hydrogen-rich gaseous stream and contacting the resulting stream with a hydrogenation catalyst comprising platinum or palladium in a second hydrogenation zone to saturate aromatic compounds; (d) passing the resulting effluent from the second hydrogenation zone to a first vapor-liquid separator operated at a temperature from about 149° C. (300° F.) to about 260° C. (500° F.) to maintain the waxy hydrocarbonaceous stream as a liquid; (e) passing the liquid waxy hydrocarbonaceous stream from the first vapor-liquid separator to a fractionation zone; (f) passing a vapor stream comprising hydrogen and non-waxy hydrocarbons from the first vapor-liquid separator to a second vapor-liquid separator operated at a temperature from about 10° C. (50° F.) to about 65° C. (150° F.); (g) passing at least a portion of a third hydrogen-rich gaseous stream recovered from the second vapor-liquid separator to provide at least a portion of the first hydrogen-rich gaseous stream in step (b) and at least a portion of the second hydrogen-rich gaseous steam in step (c); (h) passing a stream comprising non-waxy hydrocarbons from the second vapor-liquid separator to a fractionation zone; and (i) recovering a food grade wax having a concentration of aromatic compounds of less than about 1 wt. %.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a more efficient and economical production of food grade wax having ultra-low concentrations of sulfur, nitrogen and aromatic compounds can be achieved and enjoyed in the above described integrated, two-stage hydrogenation process. Therefore, the present invention is able to produce food grade wax from waxy petroleum-derived feedstocks. The process is particularly useful for hydrofinishing of wax to produce a highly refined wax which may be characterized as food grade wax.

Suitable waxy feedstocks are selected from the group consisting essentially of de-oiled paraffin waxes, de-oiled microcrystalline waxes, deasphalted residual oils and slack wax.

The selected feedstock is first admixed with a hydrogen-rich gaseous stream and introduced into a first hydrogenation reaction zone operated at hydrogenation reaction conditions. Preferred hydrogenation reaction conditions include a temperature from about 260° C. (500° F.) to about 482° C. (900° F.), a pressure from about 3.5 MPa (500 psig) to about 17.3 MPa (2500 psig) and a liquid hourly space velocity (LHSV) of the hydrocarbonaceous feedstock from about 0.1

$hr^{-1}$ to about 10 $hr^{-1}$ with a hydrotreating catalyst or a combination of hydrotreating catalysts.

Suitable hydrotreating catalysts for use in the lead hydrogenation zone of the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. A preferred hydrotreating catalyst for use in the lead hydrogenation zone comprises nickel, molybdenum and phosphorus. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical hydrogenation temperatures range from about 149° C. (300° F.) to about 371° C. (700° F.) with pressures from about 3.5 MPa (500 psig) to about 17.3 MPa (2500 psig).

After the hydrocarbonaceous feedstock has been hydrogenated in the first or lead hydrogenation zone, the resulting uncooled effluent is introduced into a hot, high-pressure stripping zone maintained at essentially the same pressure as the first hydrogenation zone and contacted with a hydrogen-rich gaseous stream to produce a gaseous stream comprising ammonia, hydrogen sulfide and non-waxy hydrocarbons. The stripping zone is preferably maintained at a temperature in the range from about 149° C. (300° F.) to about 293° C. (560° F.) and wherein the hydrogen-rich gaseous stream is introduced in an amount from about 8.42 $nm^3/m^3$ (50 SCFB) to about 842 $nm^3$ $m^3$ (5000 SCFB), based on the feedstock. By maintaining the pressure of the stripping zone at essentially the same pressure as the first hydrotreating reaction zone is meant that any difference in pressure is due to the pressure drop required to flow the effluent stream from the first hydrogenation zone to the stripping zone. It is preferred that the pressure drop is less than about 100 psig.

At least a portion of the resulting waxy liquid hydrocarbonaceous stream recovered from the lower end of the stripping zone is introduced along with a hydrogen-rich gaseous stream into a second hydrogenation reaction zone operated at hydrogenation reaction conditions. The operating conditions utilized in the second hydrogenation reaction zone may conveniently and preferably be selected from those disclosed hereinabove. The catalyst employed in the second hydrogenation reaction zone comprises platinum or palladium. The resulting effluent from the second hydrogenation reaction zone is introduced into a hot vapor liquid separator preferably operated at a temperature from about 149° C. (300° F.) to about 260° C. (500° F.). A hot gaseous effluent is removed from the hot vapor-liquid separator and admixed with at least a portion of the hot gaseous stream recovered from the hot, high pressure stripping zone and comprising hydrogen, hydrogen sulfide, ammonia and non-waxy hydrocarbons, and the resulting admixture is cooled and introduced into a cold vapor-liquid separator. A hot liquid stream containing waxy hydrocarbons is removed from the hot vapor-liquid separator and introduced into a stripper, preferably a vacuum steam stripper, to remove low boiling, non-waxy distillate hydrocarbons overhead and a food grade wax product stream preferably containing less than about 5 wppm nitrogen, about 5 wppm sulfur and about 1 wt. % aromatic compounds.

A hydrocarbon condensate stream containing non-waxy hydrocarbons is removed from the cold vapor-liquid separator and preferably introduced into the stripper. A hydrogen-rich gaseous stream containing hydrogen sulfide and ammonia is removed from the cold vapor-liquid separator and preferably introduced into an acid gas scrubber to remove, in one embodiment, hydrogen sulfide and ammonia before being compressed. The gas in the scrubber is contacted with an acid gas absorbent, preferably an aqueous amine scrubbing solution. Make-up hydrogen gas may be introduced into the process at any convenient location, preferably immediately upstream of the hydrogen recycle compressor. At least a portion of compressed hydrogen-rich gas is preferably introduced in the first and second hydrogenation zones, and the hot, high-pressure stripper.

DETAILED DESCRIPTION OF THE DRAWING

A microcrystalline wax feedstock is introduced via line 1 and is admixed with a hydrogen-rich gaseous stream provided via line 23 and the resulting admixture is carried via line 2 and introduced into hydrogenation zone 3. The resulting effluent from hydrogenation zone 3 is transported via line 4 and introduced into hot, high-pressure stripper 5 via line 31 and is contacted with an upwardly flowing hydrogen-rich gaseous stream comprising hydrogen which is introduced via line 8. A gaseous stream is removed from hot, high-pressure stripper 5 via line 6. A liquid stream is removed from hot, high-pressure stripper 5 via line 7 and is admixed with a hydrogen-rich gaseous stream provided via line 22 and the resulting admixture is transported via line 10 and introduced into hydrogenation zone 11. A resulting liquid stream is removed from hydrogenation zone 11 via line 12 and introduced into hot vapor-liquid separator 13. A liquid stream is removed from hot vapor-liquid separator 13 via line 25 and introduced into stripper 26. A gaseous stream is removed from hot vapor-liquid separator 13 via line 14 and is admixed with a previously described gaseous stream carried via line 6 and the resulting admixture is transported via line 15 and introduced into heat exchanger 16. The resulting cooled effluent from heat exchanger 16 is carried via line 17 and introduced into cold vapor-liquid separator 18. A hydrogen-rich gaseous stream containing hydrogen sulfide is removed from cold vapor-liquid separator 18 via line 19 and introduced into acid gas scrubber 32. A lean aqueous absorbent is introduced into acid gas scrubber 32 via line 33 and a rich aqueous absorbent is removed from acid gas scrubber 32 via line 34 and recovered. A hydrogen rich gaseous stream containing a reduced concentration of hydrogen sulfide is removed from acid gas scrubber 32 via line 35 and admixed with hydrogen make-up gas provided by line 36. The resulting admixture is introduced via line 37 into compressor 20 and compressed. The compressed hydrogen-rich gaseous stream is transported via lines 21, 22, 8 and 23. A liquid stream is removed from cold vapor-liquid separator 18 via line 24 and introduced into stripper 26. A wild distillate stream is removed from stripper 26 via line 27 and recovered. Steam is provided via line 28 and introduced into stripper 26. A hydrofinished liquid wax stream is removed from stripper 26 via line 29 and recovered.

The process of the present invention is further demonstrated by the following illustrative embodiment. This illustrative embodiment is, however, not presented to unduly limit the process of this invention, but to further illustrate the advantage of the hereinabove described embodiment. The following data were not obtained by the actual performance of the present invention but are considered prospective and reasonably illustrative of the expected performance of the invention.

ILLUSTRATIVE EMBODIMENT

A mid-melt microcrystalline wax feedstock in an amount of 100 mass units and having the characteristics presented in Table 1 is admixed with hydrogen and introduced into a first hydrogenation reaction zone operated at a temperature of 343° C. (650° F.) and a pressure of 16 MPa (2300 psig) to reduce the concentration of sulfur, nitrogen and aromatic compounds. The resulting effluent from the first hydrogenation reaction zone is introduced into a hot, high pressure stripper operated at a temperature of 218° C. (425° F.) and a pressure of 15.6 MPa (2250 psig), and stripped with hydrogen in an amount of about 843 $nm^3/m^3$ (500 SCFB) based on fresh feed. The resulting hot stripped liquid which is saturated with hydrogen is admixed with additional hydrogen and introduced into a second hydrogenation zone operated at a temperature of 274° C. (525° F.) and a pressure of 15.6 MPa (2250 psig).

TABLE 1

| Mid-Melt Microcrystalline Wax | |
|---|---|
| Specific Gravity @ 16° C. | 0.88 |
| Melt Point, ° C. | 86–92 |
| ASTM Color, D1500 | <5 |
| Sulfur, ppm | 195 |
| Nitrogen, ppm | 333 |

The resulting effluent from the second hydrogenation zone is fractionated to produce 0.6 mass units of naphtha, 1.3 mass units of gas oil and 981 mass units of micro wax. The resulting product properties are summarized in Table 2.

TABLE 2

| | Product Properties | | |
|---|---|---|---|
| | Naphtha | Gas Oil | Micro Wax |
| Specific Gravity @ 16° C. | 0.754 | 0.811 | 0.878 |
| Nominal Cut | $C_6$– 180° C. | 180–371° C. | 371+° C. |
| True Boiling Point Distillation, ° C. | | | |
| 10% | 104 | 221 | >426 |
| 50% | 132 | 274 | >538 |
| 90% | 165 | 349 | — |
| Melt Point, ° C. | | | 88 |
| Saybolt Color | | | +16 |
| FDA Test | | | Pass |
| Light Stability | | | Pass |

The foregoing description, drawing and illustrative embodiment clearly illustrate the advantages encompassed by the process of the present invention and the benefits to be afforded with the use thereof.

What is claimed is:

1. A process for producing food grade wax from a feedstock selected from the group consisting essentially of de-oiled paraffin waxes, de-oiled microcrystalline waxes, deasphalted residual oils and slack wax which process comprises:

(a) contacting the feedstock and hydrogen with a hydrotreating catalyst in a first hydrogenation zone;

(b) passing the resulting effluent without cooling from the first hydrogenation zone to an interstage separator operated at the hydrogenation zone outlet pressure to strip hydrogen sulfide, ammonia and non-waxy hydrocarbons by countercurrent contact with a first hydrogen-rich gaseous stream;

(c) passing a liquid waxy hydrocarbonaceous stream from the interstage separator and a second hydrogen-rich gaseous stream and contacting the resulting stream with a hydrogenation catalyst comprising platinum or palladium in a second hydrogenation zone to saturate aromatic compounds;

(d) passing the resulting effluent from the second hydrogenation zone to a first vapor-liquid separator operated at a temperature from about 149° C. (300° F.) to about 260° C. (500° F.) to maintain the waxy hydrocarbonaceous stream as a liquid;

(e) passing the liquid waxy hydrocarbonaceous stream from the first vapor-liquid separator to a fractionation zone;

(f) passing a vapor stream comprising hydrogen and non-waxy hydrocarbons from the first vapor-liquid separator to a second vapor-liquid separator operated at a temperature from about 10° C. (50° F.) to about 65° C. (150° F.);

(g) passing at least a portion of a third hydrogen-rich gaseous stream recovered from the second vapor-liquid separator to provide at least a portion of the first hydrogen-rich gaseous stream in step (b) and at least a portion of the second hydrogen-rich gaseous stream in step (c);

(h) passing a stream comprising non-waxy hydrocarbons from the second vapor-liquid separator to a fractionation zone; and (i) recovering a food grade wax in step (e).

2. The process of claim 1 wherein the first hydrogenation zone is operated at conditions including a temperature from about 260° C. (500° F.) to about 482° C. (900° F.) and a pressure from about 3.5 MPa (500 psig) to about 17.3 MPa (2500 psig).

3. The process of claim 1 wherein the second hydrogenation zone is operated at conditions including a temperature from about 149° C. (300° F.) to about 371° C. (700° F.) and a pressure from about 3.5 MPa (500 psig) to about 17.3 MPa (2500 psig).

4. The process of claim 1 wherein the first hydrogen-rich gaseous stream is introduced in an amount from about 8.42 $nm^3/m^3$ (50 SCFB) to about 1684 $nm^3/m^3$ (10,000 SCFB) based on the feedstock.

5. The process of claim 1 wherein the hydrotreating catalyst in step (a) comprises nickel, molybdenum and phosphorus.

6. The process of claim 1 wherein the food grade wax has a concentration of aromatic compounds of less than about 1 wt. % and meets food grade specifications.

7. A process for producing food grade wax from a feedstock selected from the group consisting essentially of de-oiled paraffin waxes, de-oiled microcrystalline waxes, deasphalted residual oil and slack wax which process comprises:

(a) contacting the feedstock and hydrogen with a hydrotreating catalyst comprising nickel, molybdenum and phosphorus in a first hydrogenation zone;

(b) passing the resulting effluent without cooling from the first hydrogenation zone to an interstage separator operated at the hydrogenation zone outlet pressure to strip hydrogen sulfide, ammonia and non-waxy hydrocarbons by countercurrent contact with a first hydrogen-rich gaseous stream;

(c) passing a liquid waxy hydrocarbonaceous stream from the interstage separator and a second hydrogen-rich gaseous stream and contacting the resulting stream with a hydrogenation catalyst comprising platinum or palladium in a second hydrogenation zone to saturate aromatic compounds;

(d) passing the resulting effluent from the second hydrogenation zone to a first vapor-liquid separator operated at a temperature from about 149° C. (300° F.) to about 260° C. (500° F.) to maintain the waxy hydrocarbonaceous stream as a liquid;

(e) passing the liquid waxy hydrocarbonaceous stream from the first vapor-liquid separator to a fractionation zone;

(f) passing a vapor stream comprising hydrogen and non-waxy hydrocarbons from the first vapor-liquid separator to a second vapor-liquid separator operated at a temperature from about 10° C. (50° F.) to about 65° C. (150° F.);

(g) passing at least a portion of a third hydrogen-rich gaseous stream recovered from the second vapor-liquid separator to provide at least a portion of the first hydrogen-rich gaseous stream in step (b) and at least a portion of the second hydrogen-rich gaseous stream in step (c);

(h) passing a stream comprising non-waxy hydrocarbons from the second vapor-liquid separator to a fractionation zone; and (i) recovering a food grade wax in step (e).

8. A process for producing food grade wax from a feedstock selected from the group consisting essentially of dc-oiled paraffin waxes, de-oiled microcrystalline waxes, deasphalted residual oil and slack wax which process comprises:

(a) contacting the feedstock and hydrogen with a hydrotreating catalyst comprising nickel, molybdenum and phosphorus in a first hydrogenation zone operated at conditions including a temperature from about 260° C. (500° F.) to about 482° C. (900° F.) and a pressure from about 3.5 MPa (500 psig) to about 17.3 MPa (2500 psig);

(b) passing the resulting effluent without cooling from the first hydrogenation zone to an interstage separator at the hydrogenation zone outlet pressure to strip hydrogen sulfide, ammonia and non-waxy hydrocarbons by counter current contact with a first hydrogen-rich gaseous stream;

(c) passing a liquid waxy hydrocarbonaceous stream from the interstage separator and a second hydrogen-rich gaseous stream and contacting the resulting stream with a hydrogenation catalyst comprising platinum or palladium in a second hydrogenation zone to saturate aromatic compounds;

(d) passing the resulting effluent from the second hydrogenation zone to a first vapor-liquid separator operated at a temperature from about 149° C. (300° F.) to about 260° C. (500° F.) to maintain the waxy hydrocarbonaceous stream as a liquid;

(e) passing the liquid waxy hydrocarbonaceous stream from the first vapor-liquid separator to a fractionation zone;

passing a vapor stream comprising hydrogen and non-waxy hydrocarbons from the first vapor-liquid separator to a second vapor-liquid separator operated at a temperature from about 10° C. (50° F.) to about 65° C. (150° F.);

(g) passing at least a portion of a third hydrogen-rich gaseous stream recovered from the second vapor-liquid separator to provide at least a portion of the first hydrogen-rich gaseous stream in step (b) and at least a portion of the second hydrogen-rich gaseous steam in step (c);

(h) passing a stream comprising non-waxy hydrocarbons from the second vapor-liquid separator to a fractionation zone; and (i) recovering a food grade wax in step (e) having a concentration of aromatic compounds of less than about 1 wt. %.

* * * * *